US008093517B2

(12) United States Patent
Haehnel

(10) Patent No.: US 8,093,517 B2
(45) Date of Patent: Jan. 10, 2012

(54) ARRANGEMENT FOR INFLUENCING DEVICE FUNCTIONS BY MEANS OF A FOOT MOVEMENT

(75) Inventor: Bernd Haehnel, Jena (DE)

(73) Assignee: Carl Zeiss Meditec AG, Jena (DE)

( * ) Notice: Subject to any disclaimer, the term of this patent is extended or adjusted under 35 U.S.C. 154(b) by 552 days.

(21) Appl. No.: 12/301,572

(22) PCT Filed: May 12, 2007

(86) PCT No.: PCT/EP2007/004228

§ 371 (c)(1),
(2), (4) Date: Nov. 19, 2008

(87) PCT Pub. No.: WO2007/134738

PCT Pub. Date: Nov. 29, 2007

(65) Prior Publication Data

US 2009/0200143 A1 Aug. 13, 2009

(30) Foreign Application Priority Data

May 19, 2006 (DE) ..... 10 2006 024 108

(51) Int. Cl.
*H01H 3/14* (2006.01)

(52) U.S. Cl. ..... 200/86.5

(58) Field of Classification Search ..... 200/86.5, 200/61.85, 334, 341–345, 61.29, 330–331
See application file for complete search history.

(56) References Cited

U.S. PATENT DOCUMENTS

| | | | | |
|---|---|---|---|---|
| 5,422,521 | A | 6/1995 | Neer et al. | |
| 5,635,777 | A | 6/1997 | Telymonde et al. | |
| 6,452,123 | B1 * | 9/2002 | Chen | 200/86.5 |
| 7,012,203 | B2 * | 3/2006 | Hanson et al. | 200/86.5 |
| 7,619,171 | B2 * | 11/2009 | Horvath et al. | 200/86.5 |
| 2007/0078539 | A1 | 4/2007 | Kuhner et al. | |

FOREIGN PATENT DOCUMENTS

| | | | |
|---|---|---|---|
| DE | 88 10 751.5 | | 11/1988 |
| DE | 39 18 673 | A1 | 12/1990 |
| DE | 41 16 370 | C1 | 5/1993 |
| DE | 197 12 795 | C2 | 10/1998 |
| DE | 200 19 995 | U1 | 4/2001 |
| DE | 103 51 199 | B3 | 6/2005 |
| WO | WO 0186369 | A1 | 11/2001 |

* cited by examiner

*Primary Examiner* — Edwin A. Leon
(74) *Attorney, Agent, or Firm* — Patterson Thuente Christensen Pedersen, P.A.

(57) ABSTRACT

An apparatus for triggering, changing or ending device functions by means of foot movements can include a resting surface for the sole of a foot and at least one switch, arranged in the region of the resting surface and at a fixed distance from the resting surface, for closing or opening an electrical or control circuit. An actuating element can be associated with the switch to initiate its switching functions. The apparatus can also include a means for transmitting foot movements to the actuating element. The switch can be a proximity switch and the actuating element can be mounted such that it can move in a direction following the respective foot movement, with the result that, owing to the foot movement, the actuating element can be brought closer to the proximity switch therefore triggering the switching function.

11 Claims, 2 Drawing Sheets

ARRANGEMENT FOR INFLUENCING DEVICE FUNCTIONS BY MEANS OF A FOOT MOVEMENT

PRIORITY CLAIM

The present invention claims priority to PCT application no. PCT/EP2007/004228, filed May 12, 2007, which claims priority to German patent application no. DE 10 2006 024 108.8, filed May 19, 2006.

FIELD OF THE INVENTION

The invention relates to an arrangement for triggering, changing or ending device functions by means of foot movements.

BACKGROUND OF THE INVENTION

For controlling electrical devices, including controlling devices for medical treatment, it is known that foot switches or foot pushbuttons are used, which are connected to the respective device with appropriate cables or leads, and which transmit the particular switch position or switch specification as a signal to such a device.

For example, in DE 103 51 199 B3, a switching installation consisting of several such foot switches is described, which is used to trigger control signals for operating electromedical devices or device assemblies. Each one of the therein described foot switches possesses a resting surface for the sole of the foot which is to be placed on said resting surface for actuation. Actuation is triggered through up and down movements of the foot or the sole of the foot around the area of the toes, e.g., by placing the heel outside of the foot switch.

DE 200 19 995 U1 shows a multifunctional foot switch, whereby, in comparison to the aforementioned publication, the number of functions controllable by foot is multiplied by means of a gliding mechanism to be actuated by the tip of the toe, and which can be assigned selectively with several different switching functions.

From DE 197 12 795 C2 a device interacting with a foot switch installation for manual laser materials processing is known, whereby in the area of the foot resting surface, the foot switch installation contains several switches, which, selectively, can be reached individually with the tip of the toe. In order to adjust laser processing data during processing, the tip of the toe is moved and placed on the necessary switch to be actuated. Said invention also requires actuation through up and down movement of the foot or the sole of the foot in the toe area of the foot.

The inventions described are, disadvantageously, relatively heavy and cost-intensive and, for the purpose of signal triggering and signal transfer, require relatively complicated assemblies of the connecting cables. Furthermore, it is necessary to observe the switch as well as the correct alignment of foot and switch before actuation in order to avoid triggering a malfunction or unwanted signals. This applies particularly to the latter foot switch installation.

Particularly in connection with the development of foot switches for operating medical devices used in the operating room, said switches require rigidity and small size as well as splash water protection in order to withstand high mechanical stress over a long useful life, and which, in extreme cases, also allow for the body weight of the surgeon, and for quick and uncomplicated cleaning due to sterilization requirements.

SUMMARY OF THE INVENTION

Based on the aforementioned, the invention is based on the objective to create arrangements for triggering, changing or ending device functions by means of foot movements through which several switching functions can be executed in a simple fashion and which, furthermore, meet the constructive requirements with regard to operating safety, longevity, and small size.

According to the invention, this objective is achieved by an arrangement for triggering, changing or ending device functions by means of foot movements, including a resting surface for the sole of the foot, at least one switch, which is arranged in the area of the resting surface and at a preferably fixed distance from the resting surface, for opening or closing an electrical or control circuit, an actuating element, which is associated with the switch and initiates its switching functions if required, as well as means for transmitting up and down movements, rotations or tilting of the foot onto the actuating element, whereby the switch is in the form of a proximity switch and the actuating element is mounted such that it can move in a direction following the respective foot movement with the result that, owing to the foot movement, the actuating element can be brought closer to the proximity switch and, therefore, trigger the switching function.

According to the invention, proximity switches are any and all installations which are capable of closing or opening an electrical or control circuit by bringing an object serving as actuating element closer to the switch. Direct contact of the actuating element with the proximity switch is not necessary because the switching function is already triggered when the actuating element is positioned at a certain distance from the proximity switch which is either specified by the manufacturer or adjustable by the user.

The actuating element is not directly integrated in the electrical or control circuit, i.e., it is not connected to cables or lines, it requires no line voltage supply or electrical connection to a signal or information-providing assembly because it is free moving and functional solely on the basis of its material properties and the distance from the proximity switch. This results in the essential advantage that the actuating element is easily designable in a small size. Only the proximity switch, which is arranged, preferably stationary, close to the resting surface for the sole of the foot, must be included in the cable and line routing.

In a particularly advantageous version of the arrangement according to the invention, two proximity switches are positioned in the toe area of the foot resting on the resting surface, and two actuating elements are arranged on a mounting bracket encompassing the toe area, whereby one of the actuating elements is assigned to one of the proximity switches, so that by means of a lateral movement of the toe area, particularly through foot rotation around the resting heel in one or the other direction, the actuating element approaches one or the other proximity switch.

Advantageously, this can allow for the operator of an electromedical device to trigger a switching function, such as activation of a laser beam, by rotating his/her foot around the axis of the lower leg, e.g., inward. Through a rotation in the opposite outward direction, an approach of the second actuating element toward the second proximity switch can be affected, which triggers a switching function for deactivation of the laser beam.

Analogously, it is also imaginable to influence or change a device function through parameter changes, whereby, for example, the approach of the actuating element towards the respective proximity switch triggers a switching impulse which is used for changing laser beam parameters, such as output, pulse duration, interval, and/or brightness of the directional beam. For example, with every inward rotation of the foot, the proximity switch can be activated in order to increase amplitude or pulse width of the laser beam by a certain amount, while an outward rotation of the foot and accompanying activation of the second proximity switch would trigger a gradual decrease of amplitude or pulse width.

The arrangement according to the invention is particularly advantageous for applications in connection with laser processing devices for ophthalmological treatment.

The mounting device for the actuating elements can be equipped with means for direct attachment to the footwear. For example, it is conceivable that a bracket in the toe area is attached to the surgeon's shoe, and onto which the actuating elements—depending on the function of the proximity switches, for example, in the form of small magnets—are attached on both sides, i.e., left and right of the toe area. This way, the actuating elements are not only constantly available to the surgeon but actuation of the proximity switches through third parties or unauthorized persons is also prevented, whenever the surgeon (with the actuating elements) moves away from the area of the device.

Within the scope of the invention, versions are possible in which the mounting device is in the form of a bracket, pivotable around a joint, and arranged above or below the resting surface of the sole of the foot, or which is mounted for slidable motion on a sliding bar above or below the resting surface, whereby the swivel or sliding directions correspond with the directions of the toe area during the foot rotation, as described above. In this version, the actuating elements are constantly standing by for triggering a switching function, even if the surgeon has moved away from the device. Even though this allows third parties to activate the proximity switch, it also guarantees that the actuating elements are fastened to the arrangement according to the invention and are, therefore, arranged undetachably.

Possible proximity switches can be either non-contacting capacitive proximity switches, in which, as a rule, an oscillator is mistuned due to the approach of the actuating element and the resulting capacitance change, as well as non-contacting inductive proximity switches, through which the approach of the actuating element causes the suspension of electric oscillations. In the case of capacitive proximity switches, the actuating element should be made of an electrically nonconducting material whereas the actuating element for inductive proximity switches should be made of electrically conductive material.

Particularly advantageous for the use of proximity switches are reed relays, whereby the approach of a magnet influences the position of electrical contacts, thereby closing or opening electrical or control circuits.

As already indicated above, the proximity switch can be connected to a drive circuit for a laser processing device, whereby a laser beam source is switched on or off through actuation. Alternatively, at least one of the proximity switches can be integrated as a pulse transmitter in the control circuit, thereby changing device functions with the actuation of said switch, e.g., increasing or decreasing the amplitude or pulse width of the laser beam.

The above summary of the various embodiments of the invention is not intended to describe each illustrated embodiment or every implementation of the invention. This summary represents a simplified overview of certain aspects of the invention to facilitate a basic understanding of the invention and is not intended to identify key or critical elements of the invention or delineate the scope of the invention.

BRIEF DESCRIPTION OF THE DRAWINGS

The invention may be more completely understood in consideration of the following detailed description of various embodiments of the invention in connection with the accompanying drawings, in which.

Figure 1:
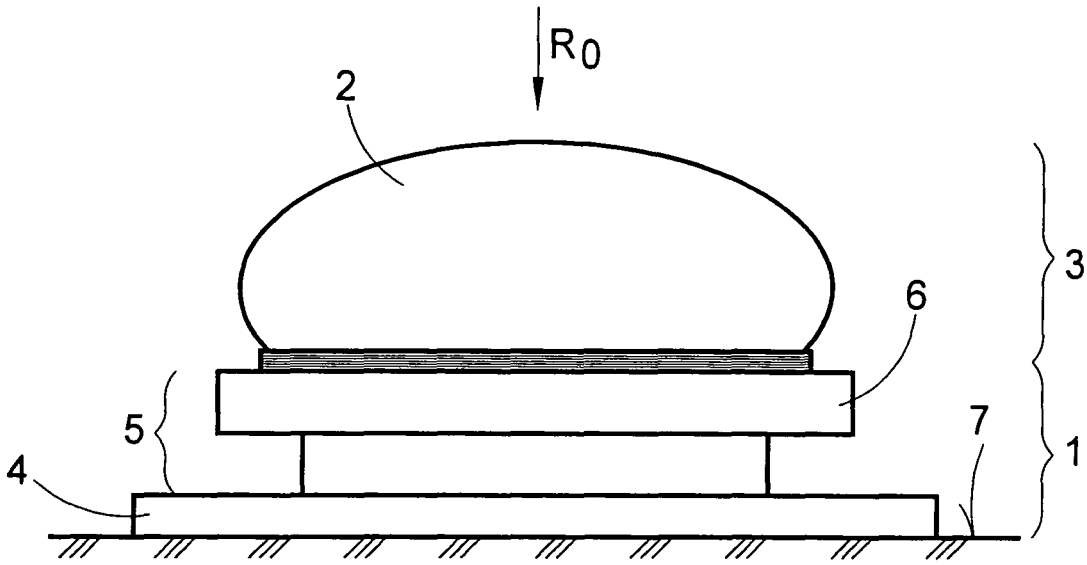
FIG. 1 depicts a foot switch as known from prior art.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION

FIG. 1 shows the principle of a foot switch 1 as known from prior art, shown from a view onto the tip 2 of footwear 3, which includes at least the toe area of a foot. Foot switch 1 includes essentially a base plate 4 and a pushbutton 5, which includes a switching element 6, and which is movably arranged, so that it can follow a foot movement in direction $R_0$ and trigger a switching function, for which pushbutton 5 is designed. It shall be assumed that pushbutton 5 serves as on- and off-switch for an electromedical device not shown in said illustrations and is, for said purpose, furthermore connected to such a device with a cable also not shown in the illustrations. Foot switch 1 rests on resting surface 7, which holds foot switch 1 and also absorbs the force which the foot applies in direction $R_0$ onto pushbutton 5.

Figure 2:
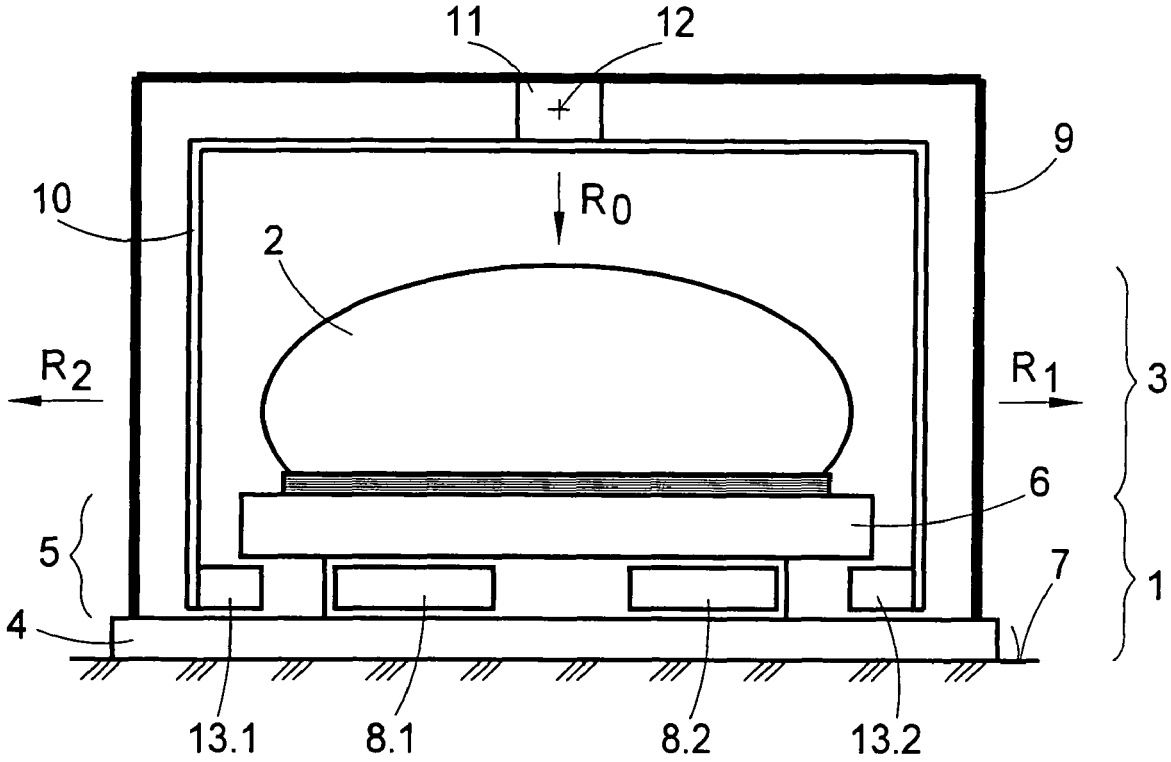
FIG. 2 depicts a first embodiment of the arrangement according to the invention.

FIG. 2 shows the arrangement according to one embodiment of the invention. As shown in FIG. 2, first and second proximity switches 8.1 and 8.2 are arranged in the area between the base plate 4 and switching element 6. In addition, foot switch 1 is covered with a foot switch cover 9, which is connected to the base plate 4 or fastened to the base plate 4.

A switching bracket 10 is suspended from the foot switch cover by means of a joint 11. Joint 11 is, for example, elastic, so that the switching bracket is laterally movable in the directions $R_1$ and $R_2$ towards the tip of the toe 2. Of course, joint 11 can also be constructed in other ways, e.g., as ball joint or pivot bearing, whereby the switching bracket 10 is movable around an axis 12 in the directions $R_1$ and $R_2$.

First and second actuating elements 13.1 and 13.2 are attached to switching bracket 10, whereby actuating element 13.1 is assigned to proximity switch 8.1 and actuating element 13.2 to proximity switch 8.2. Proximity switches 8.1 and 8.2 are, for example, reed relays, and the assigned actuating elements 13.1 and 13.2 are magnets. The principle of actuating reed relays is generally known. For example, they are constructed as reverse contacts, whereby a magnetic force pushes electrical contacts towards each other until they touch, while a decrease in or interruption of the magnetic force moves the reverse contacts away from each other.

When a rotational movement of the foot moves the tip of the toe 2 laterally in the direction $R_1$, contact with switching bracket 10 occurs, which in turn follows the movement of the tip of the toe 2 in the direction $R_1$ causing actuating element 13.1 to approach proximity switch 8.1. Once the actuating element 13.1 is sufficiently close to proximity switch 8.1, the magnetic field emanating from actuating element 13.1 causes closing of the contacts in proximity switch 8.1, thereby prompting, by means of a connecting cable not shown in the illustration, the triggering, changing or ending of functions of the device, which is connected with this arrangement according to the invention.

Analogously, the actuation of proximity switch 8.2 is caused in the same way, whereby the tip of the toe 2 is moved in the direction $R_2$ until the actuating element 13.2 is sufficiently close to proximity switch 8.2 and triggers the switching function of proximity switch 8.2.

Resetting switching bracket 10 in its initial position, as shown in FIG. 2, is caused by a reset force, exerted by joint 11, which consists of an elastic material, onto switching bracket 10.

It is herewith expressly emphasized that the version of the invention, as shown in FIG. 2, shall only serve as an example. The invention also includes versions which provide for only one proximity switch 8.1 or 8.2 and/or only one actuating element 13.1 or 13.2. Furthermore, the construction of the proximity switches 8.1 and 8.2 is not limited to reed relays. The scope of the invention also allows for the use of inductive or capacitive proximity switches, whereby in the case of inductive proximity switches, the actuating elements 13.1 and/or 13.2 shall be made of electrically conductive material, and in the case of capacitive proximity switches, the actuating elements 13.1 and/or 13.2 shall be made of nonconductive material. The switching bracket 10 can, optionally, consist of conductive, nonconductive or magnetic material, providing for the two bottom ends of the switching bracket 10, due to their material properties, to take over the functions of actuating elements 13.1 and 13.2, making the separate actuating elements 13.1 and 13.2, as shown in FIG. 2, unnecessary. Suitable proximity switches for use in the arrangement according to the invention, are, for example, manufactured and sold by Klaschka GmbH & Co. KG, Germany.

The foot switch cover 9, which surrounds the foot switch 1, also serves as protection against triggering a switching function through falling objects striking switching element 6, as well as prevention against unintentional actuation of the foot switch 1 through undue pressure on switching element 6.

Figure 3:
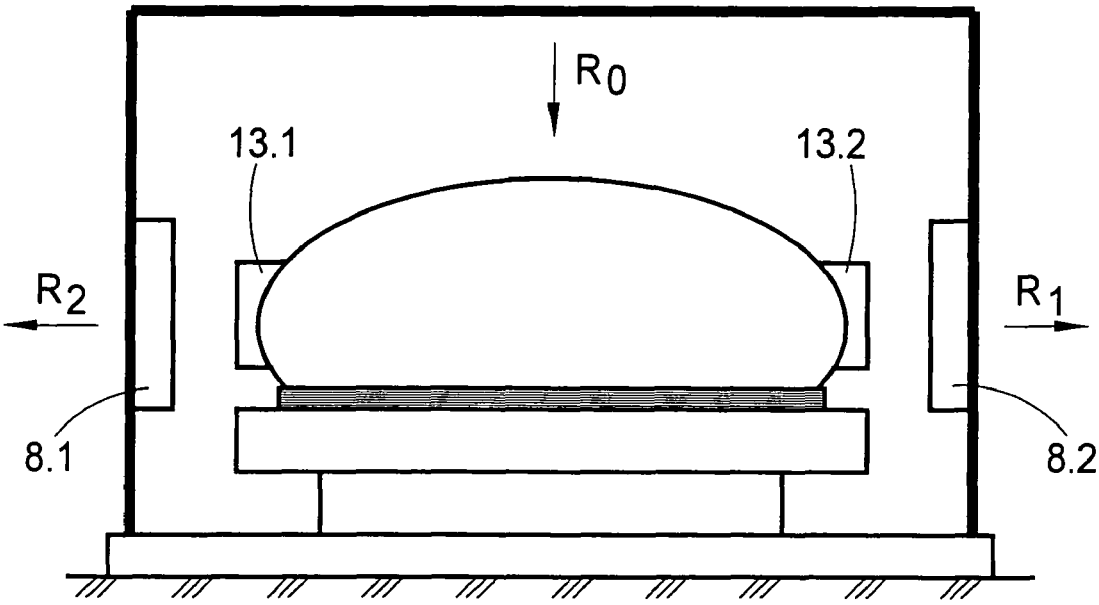
FIG. 3 depicts a second embodiment of the arrangement according to the invention.

In a separate version also serving as an example of the arrangement according to the invention, stops are provided which limit the travel of the switching bracket 10 in the directions $R_1$ and $R_2$. Furthermore, it is feasible and also within the scope of the invention to arrange the actuating elements 13.1 and 13.2, as shown as an example in FIG. 3, directly on the footwear 3 sideward from the toe area, while the proximity switches 8.1 and 8.2 are attached within the foot switch cover 9. This also allows for the approach of the actuating elements 13.1 and 13.2 toward proximity switches 8.1 and 8.2 through rotation of the foot and the actuating elements 13.1 and/or 13.2 in the directions $R_1$ and $R_2$, thereby triggering the switching functions as described above.

For the sake of completeness, it shall also be mentioned that versions of the arrangement according to the invention are feasible, which contain no conventional foot switch 1 but merely a footrest instead of said foot switch 1.

A particularly advantageous version of the arrangement according to the invention, displays within the visual range of the surgeon the status of the device functions triggered by the proximity switches, for example, "laser beam activated," "laser beam deactivated," "laser beam amplitude," "pulse width of laser beam," or other information.

Hereby, the advantage that the surgeon can trigger the switching functions through foot movement without having to look at the foot switch or take his/her eyes off the operating area becomes particularly apparent. The surgeon's attention remains focused on the operating area, uninfluenced by the actuation of the foot switch because the area to be operated on, e.g., the eye of a patient, as well as the set device parameters and device functions, are within visual range.

Various embodiments of systems, devices and methods have been described herein. These embodiments are given only by way of example and are not intended to limit the scope of the present invention. It should be appreciated, moreover, that the various features of the embodiments that have been described may be combined in various ways to produce numerous additional embodiments. Moreover, while various materials, dimensions, shapes, locations, etc. have been described for use with disclosed embodiments, others besides those disclosed may be utilized without exceeding the scope of the invention.

For purposes of interpreting the claims for the present invention, it is expressly intended that the provisions of Section 112, sixth paragraph of 35 U.S.C. are not to be invoked unless the specific terms "means for" or "step for" are recited in a claim.

The invention claimed is:

1. An apparatus for triggering, changing or ending of device functions by means of foot movement, comprising a resting surface for the sole of a foot;

at least one switch in the form of a proximity switch arranged in the region of the resting surface for closing or opening an electrical or control circuit;

an actuating element associated with the switch, the actuating element configured to selectively initiate switching functions of the switch; and wherein the actuating element is mounted such that with foot movement, the actuating element can be brought closer to the proximity switch and, therefore, trigger the switching-function; wherein the at least one switch is a first proximity switch and further comprising a second proximity switch, and wherein the resting surface has a toe area for receiving a toe portion of a foot and the toe area having two sides, and wherein the first and second proximity switches are respectively positioned on each side of the toe area of the resting surface; and the actuating element is a first actuating element and the apparatus further comprises a second actuating element, the first and second actuating elements are arranged on a mounting bracket extending on each side of the toe area, whereby each one is assigned to one of the proximity switches, so that by means of a lateral movement of the toe portion of the foot in the toe area, such as through foot rotation around a resting heel one of the first and second actuating elements approaches one of the first and second proximity switches.

2. The apparatus of claim 1, wherein the mounting bracket is directly attachable to the foot or foot wear being worn on the foot.

3. The apparatus of claim 1, wherein the mounting bracket is in the form of a switching bracket which is one of pivotable around a joint positioned above the resting surface and slidably mounted above the resting surface.

4. The apparatus of claim 1, wherein the mounting bracket is in the form of a switching bracket which is one of pivotable around a joint arranged below the resting surface slidably mounted below the resting surface.

5. The apparatus of claim 1, wherein the at least one proximity switch is a non-contacting capacitive proximity switch and the associated actuating element is electrically nonconductive.

6. The apparatus of claim 1, wherein the at least one proximity switch is a non-contacting inductive proximity switch and the associated actuating element is electrically conductive.

7. The apparatus of claim 1, wherein at least one proximity switch is in the form of a reed relay and the associated actuating element is a magnet.

8. The apparatus of claim 1, wherein the at least one proximity switch is integrated in an electrical circuit thereby one of allowing the triggering of a device function with its actuation and allowing the ending of a device function with its actuation.

9. The apparatus of claim 8, wherein the proximity switch is connected to a drive circuit for a laser processing device and laser beam sources are switched on and off through actuation.

10. The apparatus of claim 8, wherein the proximity switch is integrated in a control circuit as pulse transmitter, thereby allowing for changes of the device functions.

11. The apparatus of claim 10, wherein the proximity switch is connected to a drive circuit for a laser processing device, allowing for changes of the amplitude or pulse width of a laser beam through actuation.

* * * * *